US007284478B2

(12) United States Patent
Lee

(10) Patent No.: US 7,284,478 B2
(45) Date of Patent: Oct. 23, 2007

(54) MOLD ASSEMBLY FOR EMBOSSING THIN PRODUCTS

(76) Inventor: Chia-Shun Lee, P.O. Box 96-556, Taipei (TW) 10668

( * ) Notice: Subject to any disclaimer, the term of this patent is extended or adjusted under 35 U.S.C. 154(b) by 57 days.

(21) Appl. No.: 11/295,575

(22) Filed: Dec. 7, 2005

(65) Prior Publication Data

US 2007/0107610 A1 May 17, 2007

(30) Foreign Application Priority Data

Nov. 11, 2005 (TW) ..... 94219587 U

(51) Int. Cl.
*B26F 1/14* (2006.01)

(52) U.S. Cl. ..... 101/3.1; 101/28; 400/127; 30/358; 30/363; 83/685

(58) Field of Classification Search ..... 101/3.1, 101/28, 31.1; 30/358, 362, 363; 83/684, 83/685, 588, 698.9; 400/127, 129, 132, 133, 400/134, 134.2, 134.4
See application file for complete search history.

(56) References Cited

U.S. PATENT DOCUMENTS 5,287,397 A * 2/1994 Dumsha ..... 378/162
6,446,549 B1 * 9/2002 Soucie et al. ..... 101/4
6,739,244 B1 * 5/2004 Carbaugh ..... 101/3.1

* cited by examiner

*Primary Examiner*—Daniel J. Colilla
*Assistant Examiner*—Kevin D. Williams
(74) *Attorney, Agent, or Firm*—C. G. Mersereau; Nikolai & Mersereau, P.A.

(57) ABSTRACT

A mold assembly for embossing thin products includes a first carrier with a female mold connected to an inside thereof and a second carrier with a male mold connected to an inside thereof. The female mold faces the male mold, and the thin product is sandwiched between the male and female molds. A window is defined through the first carrier and located corresponding to the apertures of the female mold so that the user may color the thin products via the apertures of the female mold before the products are removed from the mold assembly.

4 Claims, 10 Drawing Sheets

MOLD ASSEMBLY FOR EMBOSSING THIN PRODUCTS

BACKGROUND OF THE INVENTION (1) Field of the Invention

The present invention relates to a mold assembly for embossing paper products and the paper products can be directly colored.

(2) Description of the Prior Arts

A conventional thin product can be made by using a male mold and a female mold with the thin product sandwiched between the two molds. The thin product has only 1 mm of thickness and can be a paper sheet or a metal plate. The products can be easily obtained by being sandwiched between the male and female molds without too much technique required.

However, all of the thin products made by using the press molding composed of the female mold and the male mold can only be single color or the colors cannot be sharply presented. This is because the products made by the conventional method do not have obvious difference in height between the embossed areas and the plain areas so that it is difficult to color.

The most popular way to color the embossed products is to provide a colored pattern sheet which is precisely sandwiched between the two molds to transfer the pattern on the products. Nevertheless, the result is not satisfied because the products do not have obvious periphery of the embossed area and there are many factors such as pressure and humidity, affect the result of the products.

If the products are colored after they are removed from the molds, it is a challenge to color on a smaller area of the embossed products.

The present invention intends to provide a mold assembly which includes a window through which the embossed areas are exposed and the user can conveniently color the embossed areas before the products are removed from the mold assembly.

SUMMARY OF THE INVENTION

The present invention relates to a mold assembly for embossing thin products and the mold assembly comprises a first carrier and a second carrier, wherein the first carrier has a female mold connected to an inside thereof and the second carrier has a male mold connected to an inside thereof. The female mold faces the male mold. The female mold has apertures defined therethrough and the male mold has protrusions which are sized to be engaged with the apertures. A window is defined through the first carrier and located corresponding to the apertures of the female mold. The user colors the thin products via the apertures.

The present invention will become more obvious from the following description when taken in connection with the accompanying drawings which show, for purposes of illustration only, a preferred embodiment in accordance with the present invention.

DESCRIPTION OF THE PREFERRED EMBODIMENTS

Figure 1:
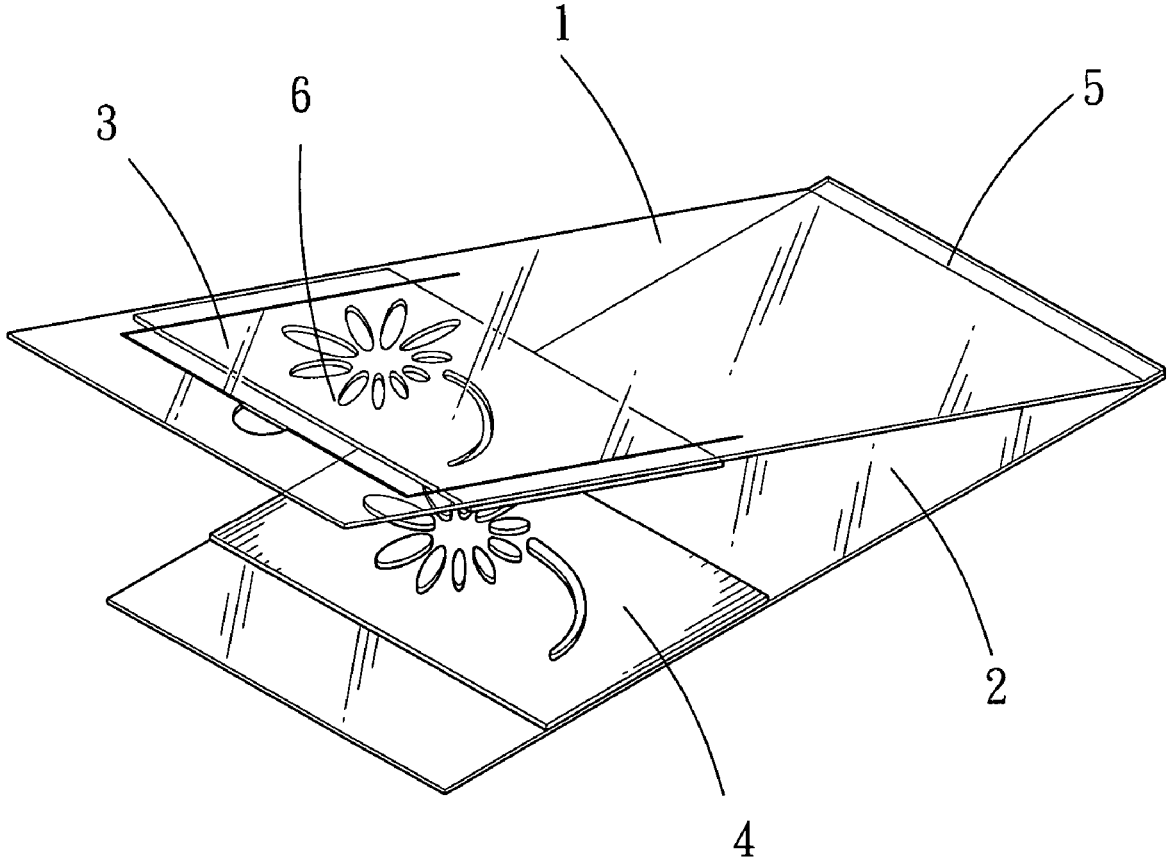
FIG. 1 is a perspective view to show the mold assembly of the present invention.
Figure 2:
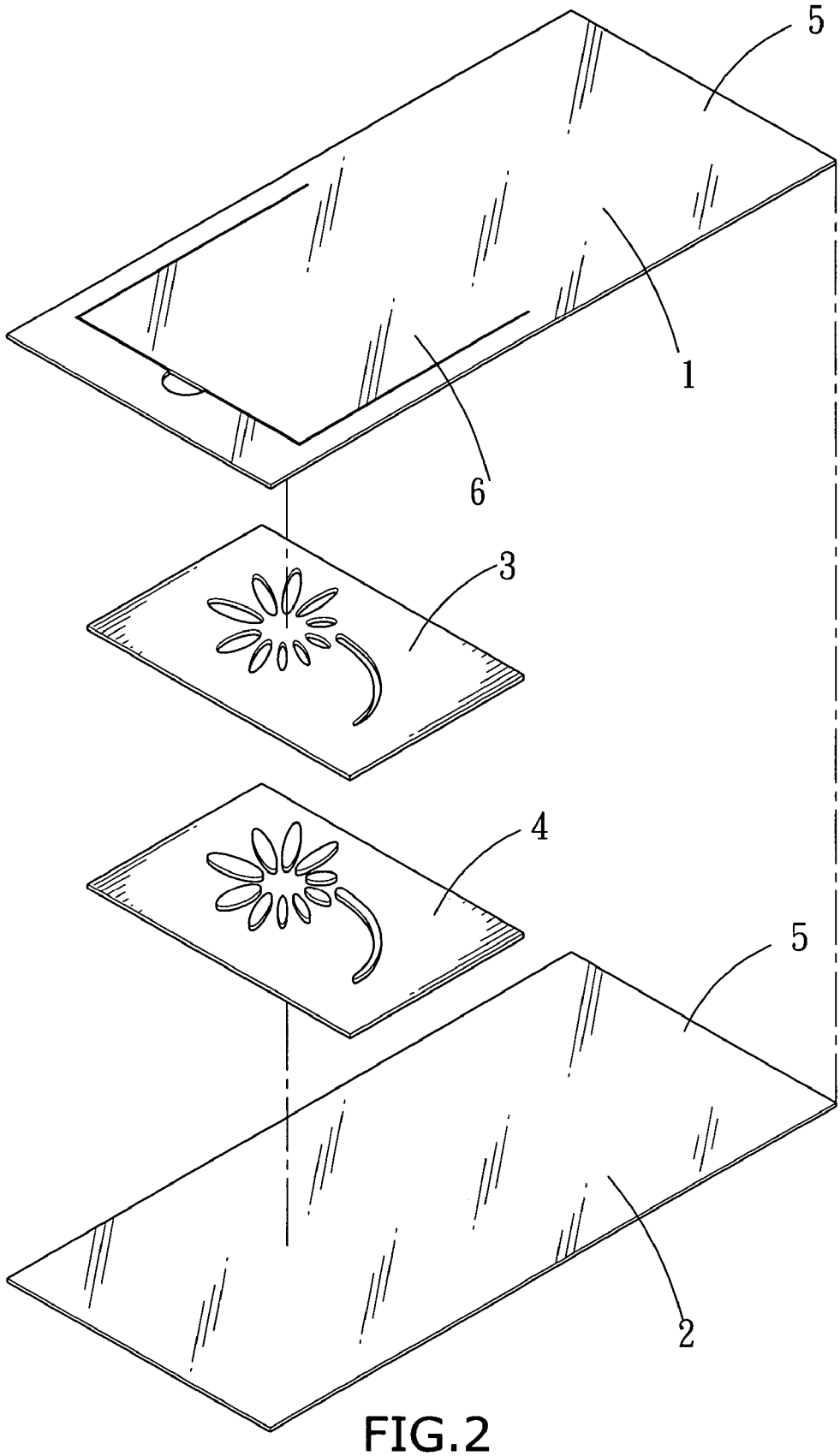
FIG. 2 is an exploded view to show the mold assembly of the present invention.
Figure 3:
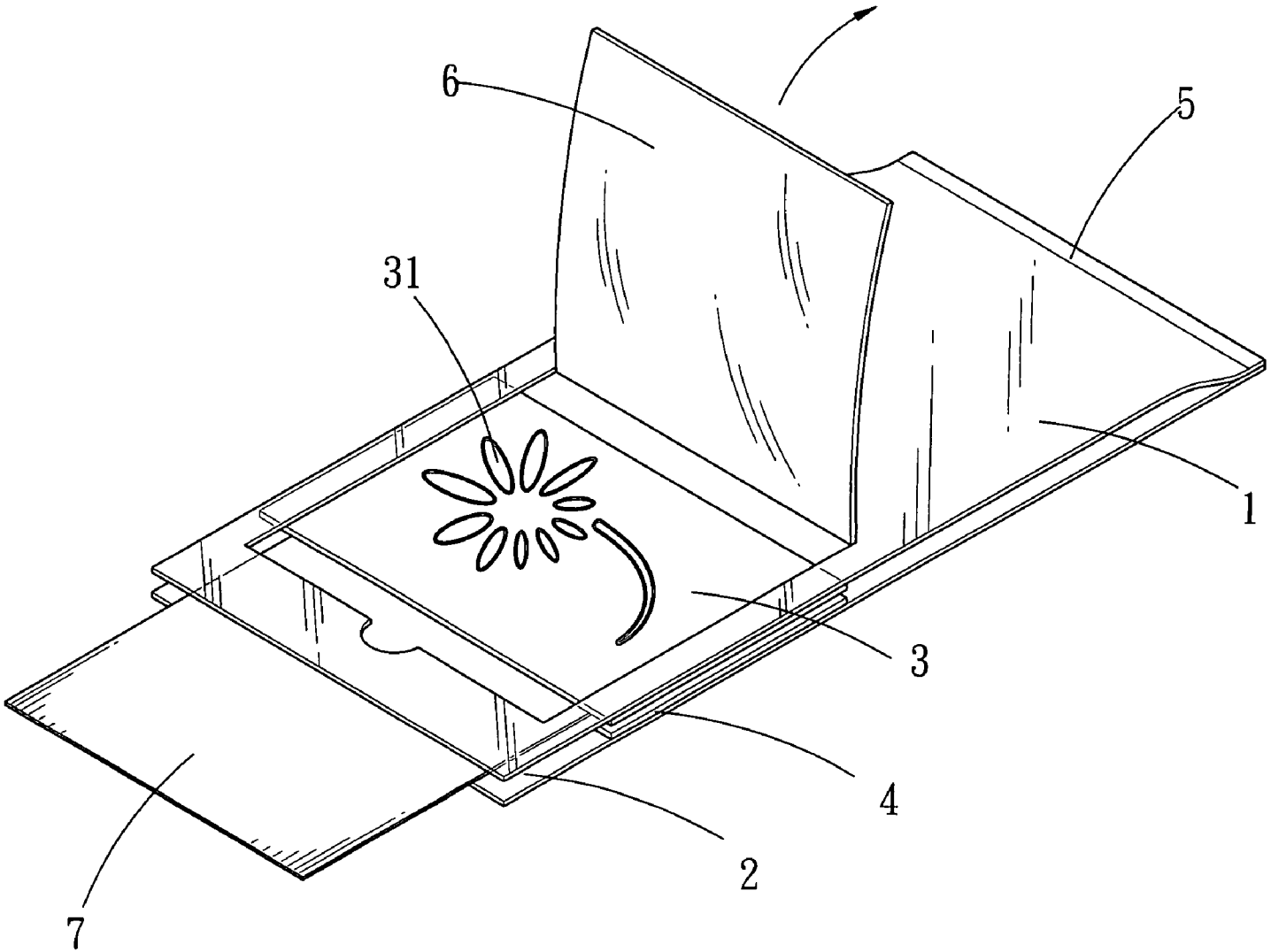
FIG. 3 shows the cover is opened to show the apertures via the window.
Figure 4:
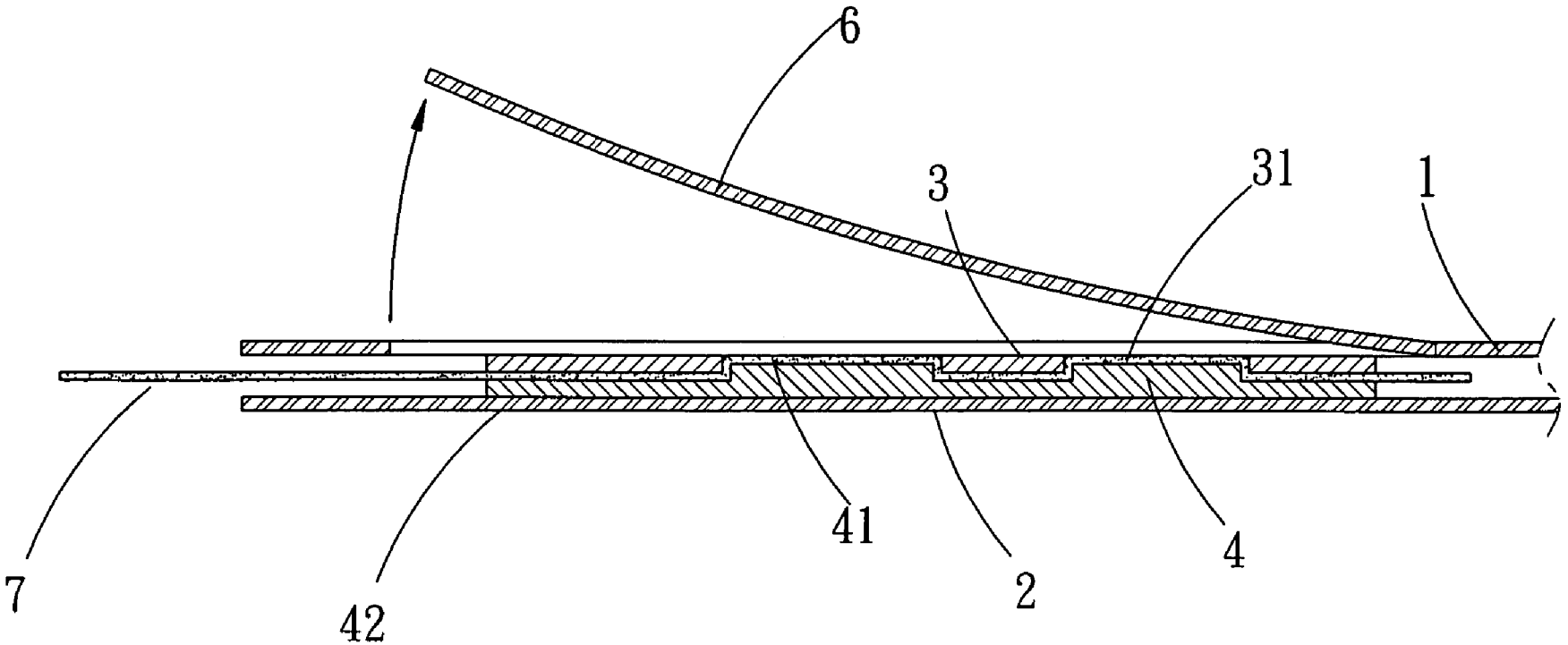
FIG. 4 is a cross sectional view to show that the cover is opened to show the apertures via the window.

Referring to FIGS. 1 to 4, the mold assembly for embossing thin products such as paper products of the present invention comprises a first carrier 1 and a second carrier 2 which is pivotably connected to one end of the first carrier 1 along a folding line. The first carrier 1 has a female mold 3 connected to an inside thereof and the second carrier 2 has a male mold 4 connected to an inside thereof. The female mold 3 faces the male mold 4. The female mold 3 has apertures 31 defined therethrough and the male mold 4 has protrusions 41 which are sized to be engaged with the apertures 31 as shown in FIG. 4.

A window is defined through the first carrier 1 and located corresponding to the apertures 31 of the female mold 3. A cover 6 is pivotably connected to a side of the window and is able to seal the window. The cover 6 can be formed by cutting a substantially U-shaped line in the first carrier 1 so that when the cover 6 is pivoted upwardly to its open position, the apertures 31 are exposed. A thin product such as a paper sheet 7 is sandwiched between the first and second carriers 1, 2 so that the paper sheet 7 is project by the protrusions 41 of the male mold 4 and exposed via the apertures 31 of the female mold 3.

Figure 5:
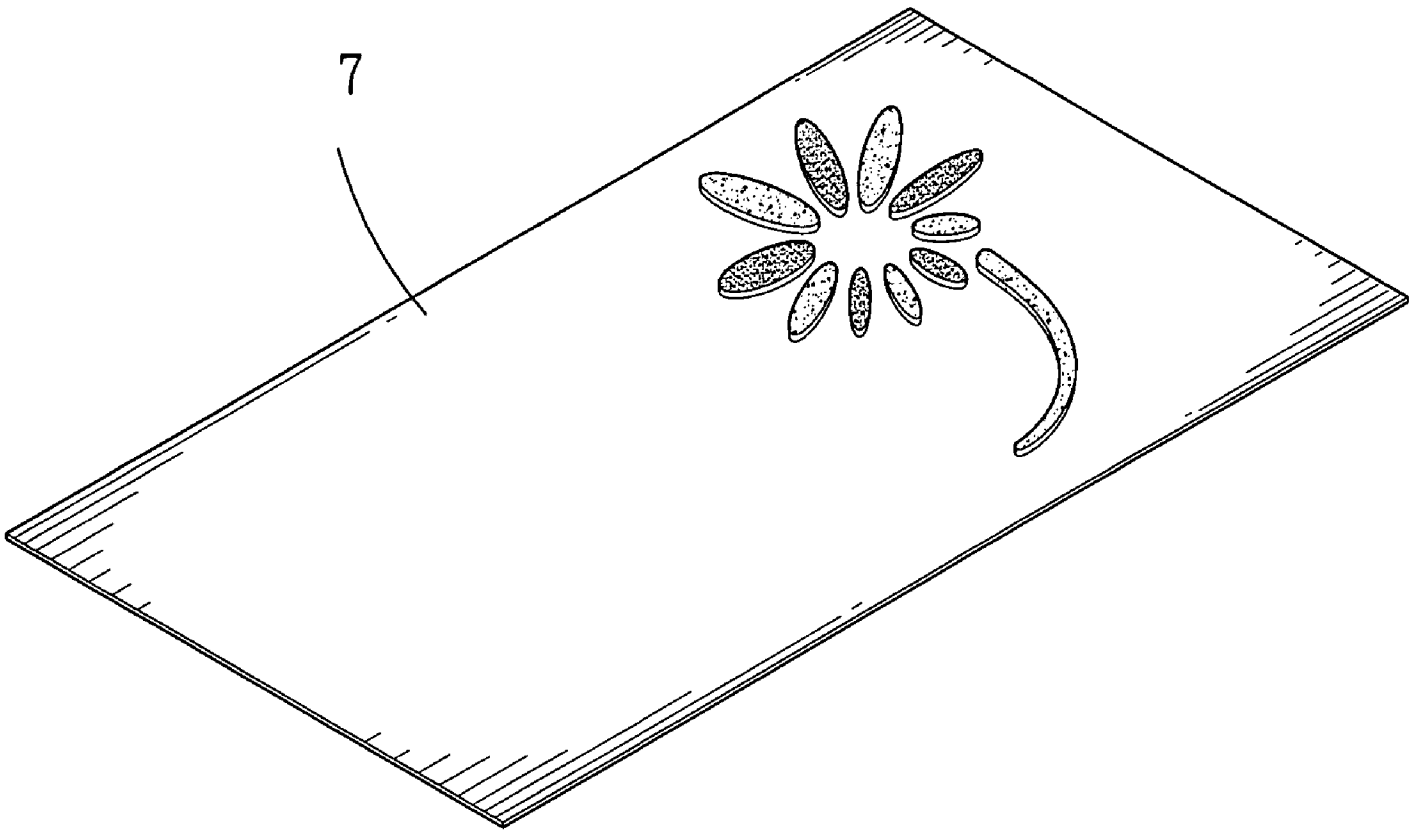
FIG. 5 is a perspective view to show the paper product made by the mold assembly of the present invention.
Figure 8:
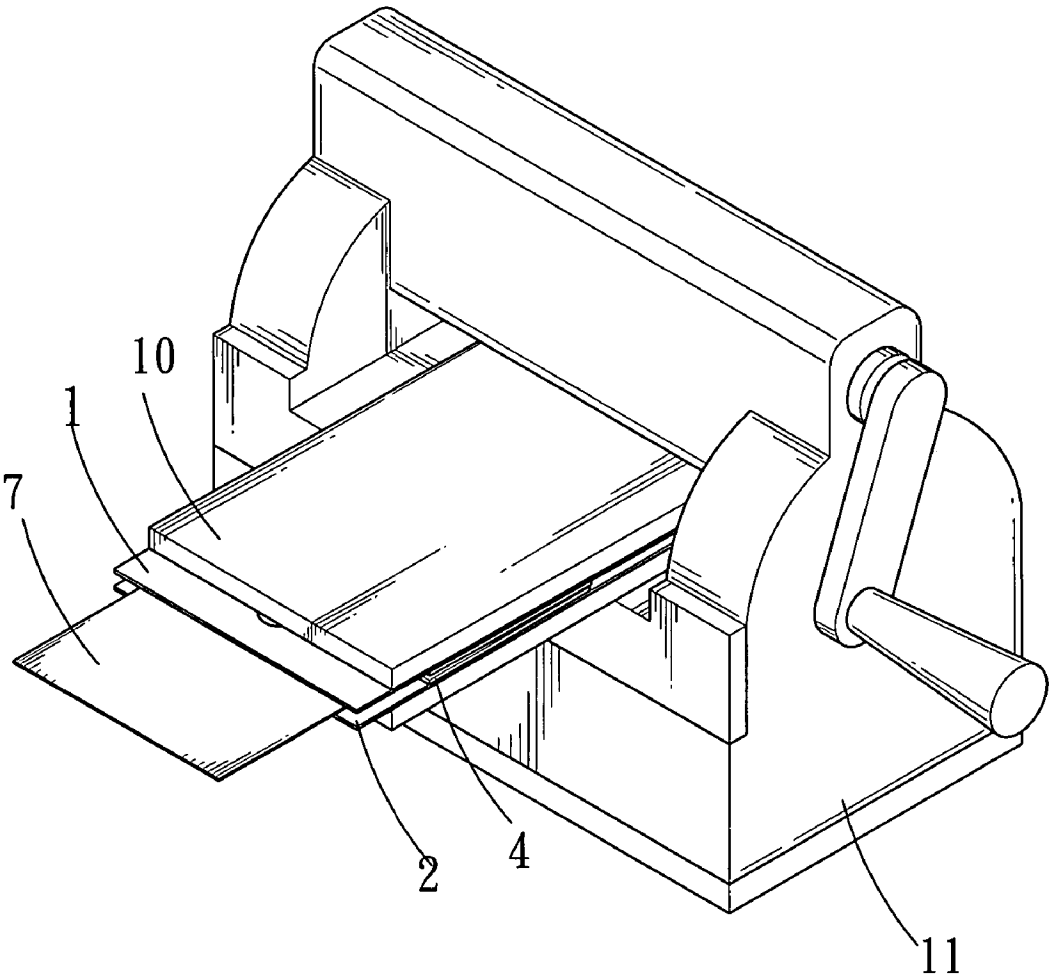
FIG. 8 shows that the mold assembly and the paper product are sent in to a roller pressing device.

Therefore, the user can color the paper sheet 7 via the apertures 31 while the paper sheet 7 is well positioned by the mold assembly. The periphery of the embossed areas which are located in the apertures 31 are conveniently to be colored and the female mold 3 can be easily cleaned up to remove the surplus coloring material. As shown in FIG. 8, the mold assembly and the paper sheet 7 are then sent into the roller pressing device 11 and protected by being sandwiched between two pads 10, the paper sheet 7 is then embossed by rotating the handle of the roller pressing device 11 as shown in FIG. 5.

Figure 6:
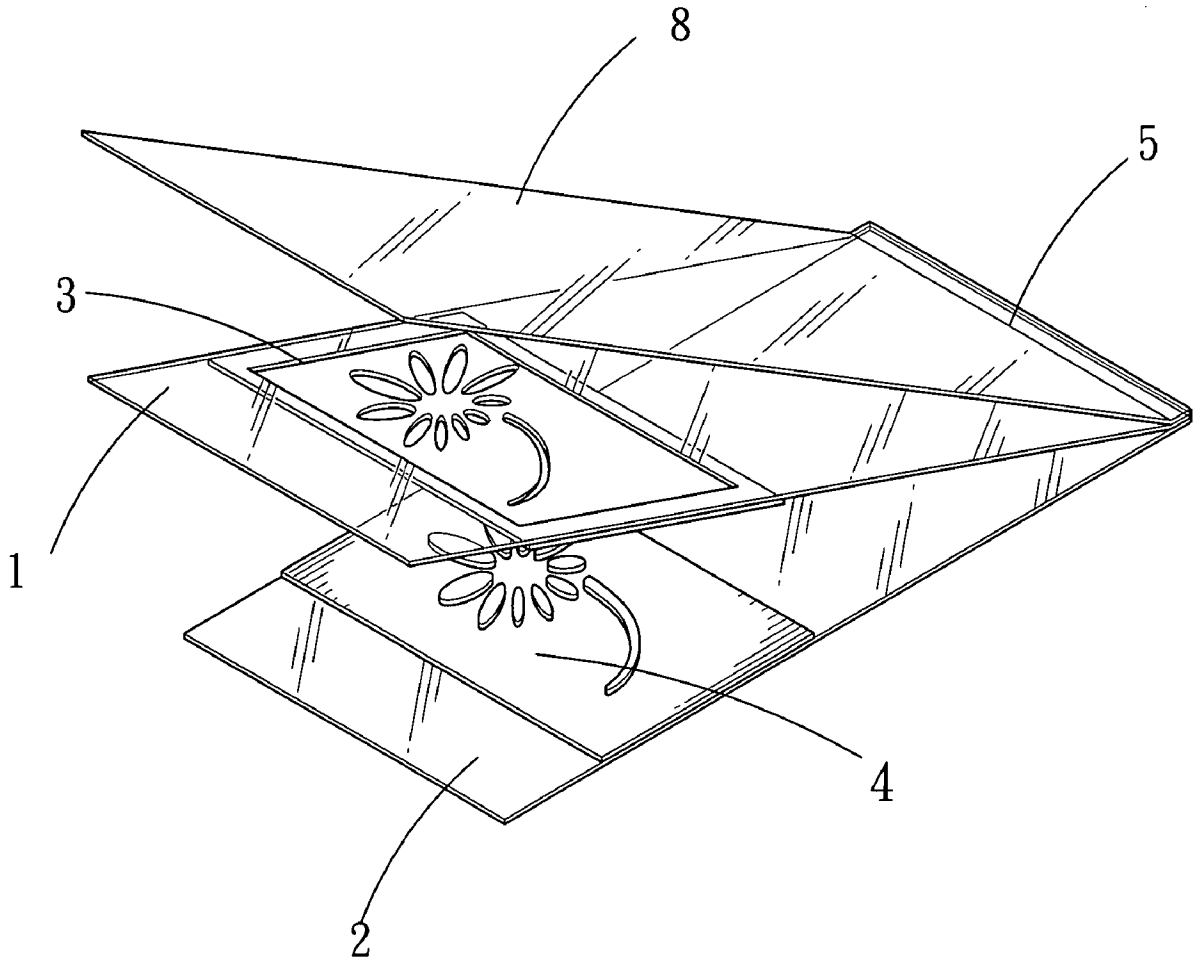
FIG. 6 is a perspective view to show another embodiment of the cover of the present invention.
Figure 7:
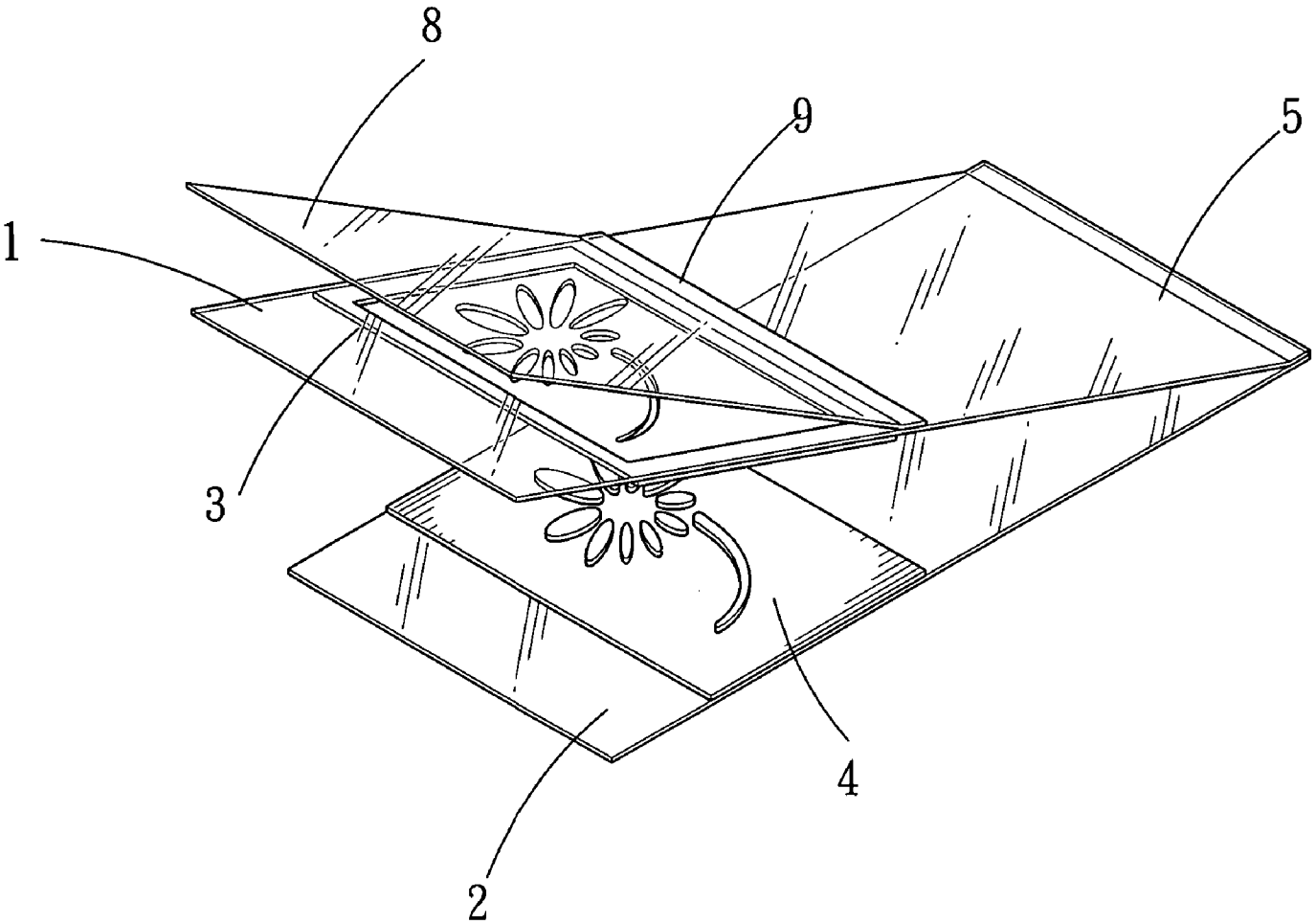
FIG. 7 shows yet another embodiment of the cover.

FIG. 6 shows that the cover 8 can be directly connected along the folding line 5 at an end of the first carrier 1 and the cover 8 encloses a larger area so that when the cover 8 is opened, there are sufficient space for the user to color the paper sheet. FIG. 7 shows that the cover 8 can also be shorter and connected to a gluing line 9 which is located along a side of the window.

Figure 9:
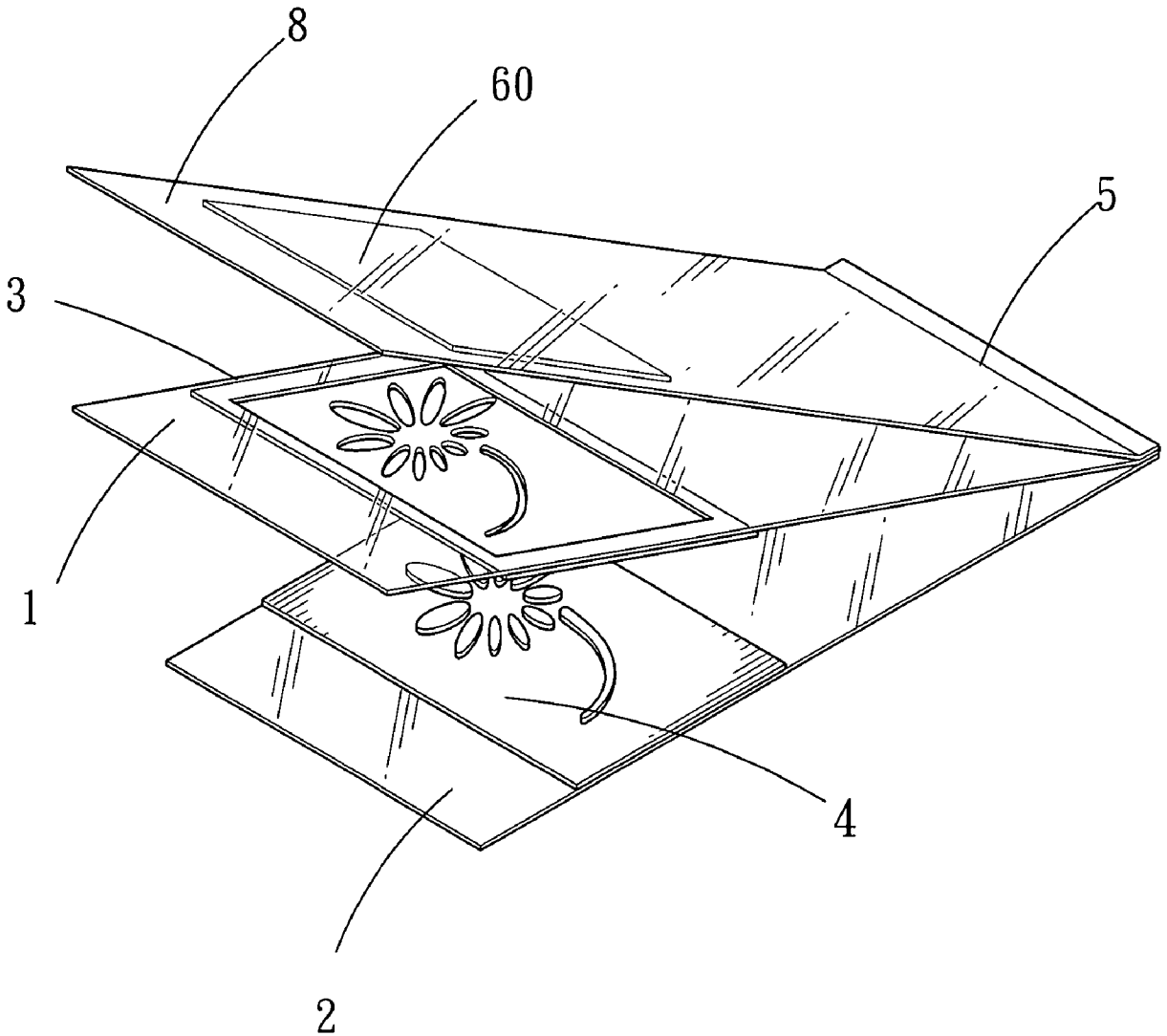
FIG. 9 shows that an attachment plate is connected to the cover.
Figure 10:
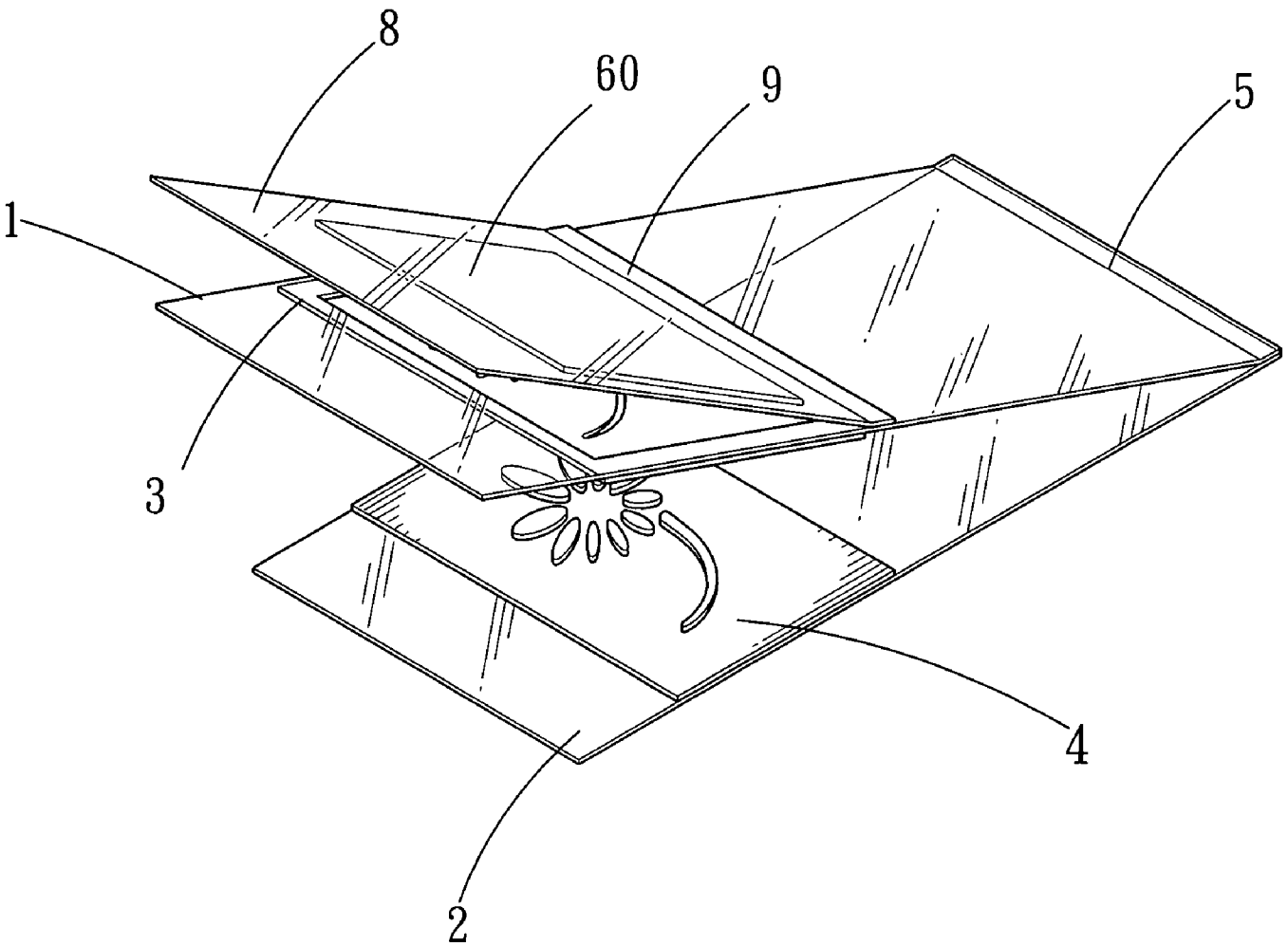
FIG. 10 shows another type of cover with the attachment plate.

FIGS. 9 and 10 show that an attachment plate 60 is connected to an inside of the cover 8 as disclosed in FIGS. 9 and 10 and the attached plate 60 is sized to be engaged with the window. It is noted that when the cover 8 is so thin that it cannot well press the paper sheet 7. The attachment plate 60 can be the cover 6 that is cut from the first carrier 1 and the attachment plate 60 increases the thickness of the area corresponding to the window so that when the first carrier 1 is pressed on the paper sheet 7, the paper sheet 7 is firmly positioned.

While we have shown and described the embodiment in accordance with the present invention, it should be clear to those skilled in the art that further embodiments may be made without departing from the scope of the present invention.

What is claimed is:

1. A mold assembly for embossing thin products, comprising:

a first carrier having a female mold connected to an inside thereof;

a second carrier having a male mold connected to an inside thereof, the female mold facing the male mold, the female mold having apertures defined therethrough and the male mold having protrusions which are sized to be engaged with the apertures;

a window defined through the first carrier and located corresponding to the apertures of the female mold so that the female mold is accessible via the window, and a cover pivotably sealing the window.

2. The assembly as claimed in claim 1, wherein the cover is pivotably connected to a side of the window.

3. The assembly as claimed in claim 1, wherein the cover is pivotably connected to an end of the first carrier.

4. The assembly as claimed in claim 3, wherein an attachment plate is connected to an inside of the cover and the attached plate is sized to be engaged with the window.

* * * * *